US010621966B2

(12) United States Patent
Kim et al.

(10) Patent No.: US 10,621,966 B2
(45) Date of Patent: Apr. 14, 2020

(54) SOUND ABSORBING AND INSULATING STRUCTURES BY TAILORING SOUND VELOCITIES, AND METHOD OF DESIGNING THE SOUND ABSORBING AND INSULATING STRUCTURES

(71) Applicant: SEOUL NATIONAL UNIVERSITY R&DB FOUNDATION, Seoul (KR)

(72) Inventors: Yoon Young Kim, Seoul (KR); Jieun Yang, Seoul (KR); Joong Seok Lee, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 321 days.

(21) Appl. No.: 15/617,762

(22) Filed: Jun. 8, 2017

(65) Prior Publication Data

US 2018/0053496 A1 Feb. 22, 2018

(30) Foreign Application Priority Data

Aug. 22, 2016 (KR) ..... 10-2016-0106386

(51) Int. Cl.
*G10K 11/172* (2006.01)
*G10K 11/168* (2006.01)
*G10K 11/16* (2006.01)

(52) U.S. Cl.
CPC ..... *G10K 11/172* (2013.01); *G10K 11/168* (2013.01)

(58) Field of Classification Search
CPC ... F01N 1/02; F01N 1/04; F02B 77/13; G10K 11/16; G10K 11/172; B60R 13/08; B64C 1/40; E04B 1/90
See application file for complete search history.

(56) References Cited

U.S. PATENT DOCUMENTS

RE22,283 E * 3/1943 Bourne ..... F01N 1/006 181/248
2,887,173 A * 5/1959 Boschi ..... E04B 9/001 181/286
2,989,136 A * 6/1961 Wohlberg ..... G10K 11/172 181/224

(Continued)

FOREIGN PATENT DOCUMENTS

JP 11-141326 A 5/1999
KR 101626093 B1 5/2016

OTHER PUBLICATIONS

Office Action corresponding to Korean Patent Application No. 10-2016-0106386, dated Nov. 21, 2017.

(Continued)

*Primary Examiner* — Edgardo San Martin
(74) *Attorney, Agent, or Firm* — Kilpatrick Townsend & Stockton LLP

(57) ABSTRACT

Provided are a sound absorbing and insulating structure is configured to be placed in a sound wave propagation path to reduce noises, and a method of designing the sound absorbing and insulating structure. The sound absorbing and insulating structure includes: a back panel arranged along a sound wave propagation path and having a flat-plate shape; a plurality of rigid partitions spaced apart from the back panel and arranged at intervals in parallel with each other so as to form resonant spaces; and a fixation frame fixing the rigid partitions to the back panel.

18 Claims, 12 Drawing Sheets

(56) References Cited

U.S. PATENT DOCUMENTS 4,069,768 A * 1/1978 Matsumoto ..... E01F 8/0041 104/124
4,158,401 A * 6/1979 Matsumoto ..... E01B 2/003 104/124
4,243,117 A 1/1981 Warnaka
4,373,608 A * 2/1983 Holmes ..... G10K 11/172 181/202
4,627,635 A * 12/1986 Koleda ..... A63C 5/07 188/268
5,014,816 A * 5/1991 Dear ..... F01N 1/02 181/229
5,240,221 A * 8/1993 Thomasen ..... F16F 7/108 181/207
5,276,291 A * 1/1994 Norris ..... E04F 17/04 181/224
5,528,005 A * 6/1996 Bschorr ..... F16F 3/02 181/208
5,583,324 A * 12/1996 Thomasen ..... F16F 3/0873 181/199
5,691,516 A * 11/1997 Thomasen ..... F16F 3/0873 181/199
5,997,985 A * 12/1999 Clarke ..... B32B 3/12 428/116
6,009,705 A * 1/2000 Arnott ..... F01N 1/02 60/312
6,435,303 B1 * 8/2002 Warnaka ..... E04B 1/86 181/286
6,719,078 B2 * 4/2004 Nakamura ..... F02M 35/10013 180/69.22
8,641,494 B2 * 2/2014 Matthews ..... E04F 17/04 181/224
8,708,272 B1 * 4/2014 Jones ..... B64C 9/18 244/1 N
9,291,104 B2 * 3/2016 Ito ..... F01D 25/04
2009/0014238 A1 * 1/2009 Huff ..... F01N 1/02 181/265

OTHER PUBLICATIONS

Materials from the Spring Season Conference on CAE and Applied Mechanics of Korean Society of Mechanical Engineers (KSME) on Apr. 8, 2016.
Materials from a session of the 12$^{th}$ World Congress on Computational Mechanics on Apr. 8, 2016.
Materials from the 6$^{th}$ Asia-Pacific Congress on Computational Mechanics (WCCM XII & APCOM VI) on Jul. 27, 2016.

* cited by examiner

SOUND ABSORBING AND INSULATING STRUCTURES BY TAILORING SOUND VELOCITIES, AND METHOD OF DESIGNING THE SOUND ABSORBING AND INSULATING STRUCTURES

CROSS-REFERENCE TO RELATED APPLICATION

This application claims the benefit of Korean Patent Application No. 10-2016-0106386, filed on Aug. 22, 2016, in the Korean Intellectual Property Office, the disclosure of which is incorporated herein in its entirety by reference.

BACKGROUND

1. Field

One or more embodiments relate to sound absorbing and insulating structures and methods of designing the sound absorbing and insulating structures, and more particularly, to sound absorbing and insulating structures configured to decrease the velocity of sound in an acoustic medium for improving the performance of sound absorption and insulation in spite of limitations on shapes and thicknesses, and methods of designing the sound absorbing and insulating structures.

2. Description of the Related Art

FIG. 2 is a view illustrating an example sound absorbing wall disclosed in Korean Patent No. 10-1626093.

Referring to FIG. 2, the invention disclosed in Korean Patent No. 10-1626093 relates to a sound absorbing wall configured to be installed in a direction substantially perpendicular to the direction of sound wave propagation. In the sound absorbing wall, porous sound absorbing material walls and rigid walls having uniform thicknesses are alternatively arranged. The invention is provided to obtain a high degree of sound absorption performance by matching impedances and adjusting the effective propagation distance of waves.

According to the invention, however, partitions having relatively complex shapes are used to adjust the effective propagation distance of waves. Thus, a sound absorbing or insulating wall having a simple structure and a method of designing the wall are required.

RELATED ART DOCUMENT

Patent Document

Korean Patent No. 10-1626093

SUMMARY

One or more embodiments include sound absorbing and insulating structures configured to be placed in a sound wave propagation path to reduce noises and methods of designing the sound absorbing and insulating structures.

Additional aspects will be set forth in part in the description which follows and, in part, will be apparent from the description, or may be learned by practice of the presented embodiments.

According to one or more embodiments, a sound absorbing and insulating structure includes: a back panel arranged along a sound wave propagation path and having a flat-plate shape; a plurality of rigid partitions spaced apart from the back panel and arranged at intervals in parallel with each other so as to form resonant spaces; and a fixation frame fixing the rigid partitions to the back panel.

The rigid partitions may have different lengths from the fixation frame.

The rigid partitions may be sequentially arranged in a long-to-short order.

A space between the back panel and the rigid partitions may be filled with an acoustic absorbent.

According to one or more embodiments, a sound absorbing and insulating structure includes: a rear panel including a rigid body and a penetration hole; a front panel arranged at a distance from the rear panel, the front panel including a rigid body and a penetration hole communicating with the penetration hole of the rear panel; and a plurality of resonators arranged between the rear panel and the front panel around a space connecting the penetration holes of the rear panel and the front panel, wherein the resonators includes a plurality of rigid partitions arranged in parallel with each other to form resonant spaces.

The rigid partitions of the resonators may have different lengths.

The rigid partitions of the resonators may be sequentially arranged in a long-to-short order.

At least one of the rigid partitions of the resonators may have an L-shape.

A space among the rigid partitions of the resonators, the front panel, and the rear panel may be filled with an acoustic absorbent.

According to one or more embodiments, there is provided a method of designing a sound absorbing and insulating structure for reducing noises by arranging a sound absorbing and insulating structure in a path along which sound waves having an audible frequency range propagate and reducing a propagation velocity of the sound waves, the method including: measuring a frequency range of sound waves; determining a size of a resonator in which resonance occurs in the measured frequency range; determining sizes and intervals of a plurality of rigid partitions so as to form resonant spaces corresponding to the determined size of the resonator; and fabricating a sound absorbing and insulating structure by arranging the rigid partitions having the determined sizes on a rigid panel at the determined intervals.

The method may further include determining whether to design a sound absorbing and insulating structure including a continuous back panel in which no penetration hole is formed or a sound absorbing and insulating structure including a resonator placed between two layers of a panel in which a plurality of penetration holes are formed.

The method may further include selecting a flat-plate shape or an L-shape as a shape of the resonant spaces of the resonator.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1A:
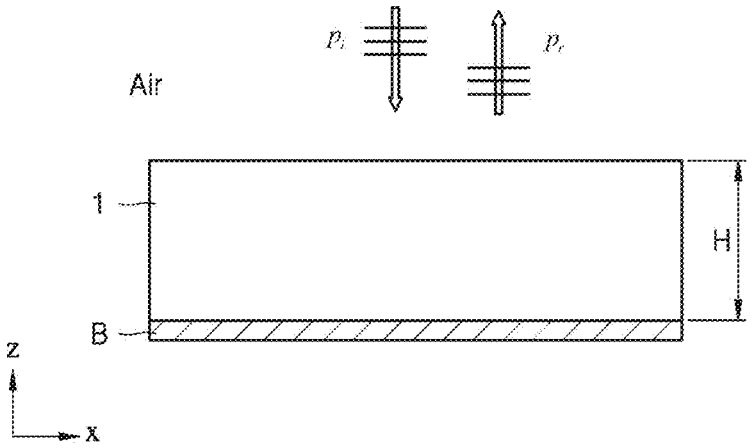
FIG. 1A is a cross-sectional view illustrating a sound absorbing wall including a rigid wall and a porous acoustic absorbent having a thickness and attached to the rigid wall.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Embodiments relate to sound absorbing and insulating structures for reducing noise, and methods of designing the sound absorbing and insulating structures. Acoustic media mainly stated in the present disclosure are air, rigid bodies, and porous acoustic absorbents.

In acoustics, the term "rigid" or "rigid body" is used to indicate a material having a very high acoustic impedance such that sound waves may not propagate through the material, and in the present disclosure, a metal or acrylic plate may be used as a rigid partition. Porous acoustic absorbents are typical materials used for sound absorption and insulation, and owing to the intrinsic characteristics and microstructure of the porous acoustic absorbents, sound wave energy transferred to the porous acoustic absorbents is dissipated. In the present disclosure, a material such as a polyurethane or polyethylene foam may be used as a porous acoustic absorbent.

According to the present disclosure, sound absorption or insulation is accomplished by reducing sound wave energy reflected from or transmitted through a sound absorbing and insulating structure when sound waves are incident on the sound absorbing and insulating structure. The performance of sound absorption or insulation is defined using a coefficient by the amount of reflected or transmitted energy measured at each frequency in a given frequency band. In the case of sound absorption, an absorption coefficient may be mainly considered, and in the case of sound insulation, a transmission coefficient or transmission loss may be mainly considered. In the present disclosure, the performance of sound insulation is indicated by transmission loss.

When discussing sound absorption, a high absorption coefficient means that the performance of sound absorption is high because the amount of reflected energy is small. Similarly, when discussing sound insulation, high transmission loss means that the amount of transmitted energy is small and thus the performance of sound insulation is high.

Embodiments 1 and 2 relate to results of approaches to sound absorption, and embodiment 3 and a modification thereof relate to results of approaches to sound insulation. In the embodiments of the present disclosure, however, the performance of sound absorption and the performance of sound insulation overlap each other to some degree, and thus sound absorbing structures and sound insulating structures of the embodiments will be referred to as sound absorbing and insulating structures.

According to the embodiments, rigid structures are inserted/arranged so as to tailor the velocity of sound in air and a porous acoustic absorbent.

During the process of inventing, it was found that the frequency at which a sound absorbing and insulating material for reducing noise has a high degree of performance is mainly determined by a relationship between a characteristic length of the sound absorbing and insulating material and the wavelength of incident waves. Embodiments provides sound absorbing panels using porous acoustic absorbents (Embodiments 1 and 2), and sound insulating panels (Embodiment 3 and a modification thereof) each constituted by two panels (or layers) in which holes are periodically formed for ventilation and heat dissipation. The sound absorption characteristics of porous acoustic absorbents are significantly affected by the thickness of the porous acoustic absorbents, and thus an acoustic absorbent having a very large thickness is installed to guarantee sound absorption performance even in a low frequency band. In the case of a sound insulating panel in which ventilation holes are periodically formed, the distance (interval) between the ventilation holes have a large effect on the frequency of a sound applied to the panel, and thus it is difficult to reduce a target frequency while guaranteeing ventilation.

Therefore, in the present disclosure, a method of tailoring the velocity of sound is used as a method of guaranteeing the performance of sound absorption and insulation at a low frequency without varying limited thicknesses and spaces.

That is, in the present disclosure, the velocity of sound in an acoustic medium is tailored to improve the performance of sound absorption and insulation of a given structure. Before describing effects obtainable by tailoring the velocity of sound in a medium, physical phenomena related to two subjects of the present disclosure, that is, a sound absorption problem using a porous acoustic absorbent and a sound insulation problem using a double panel having holes will be first described. Techniques described below were obtained during the process of inventing and have not been known in the art except for techniques described with reference to FIGS. 1A and 1B.

Figure 1B:
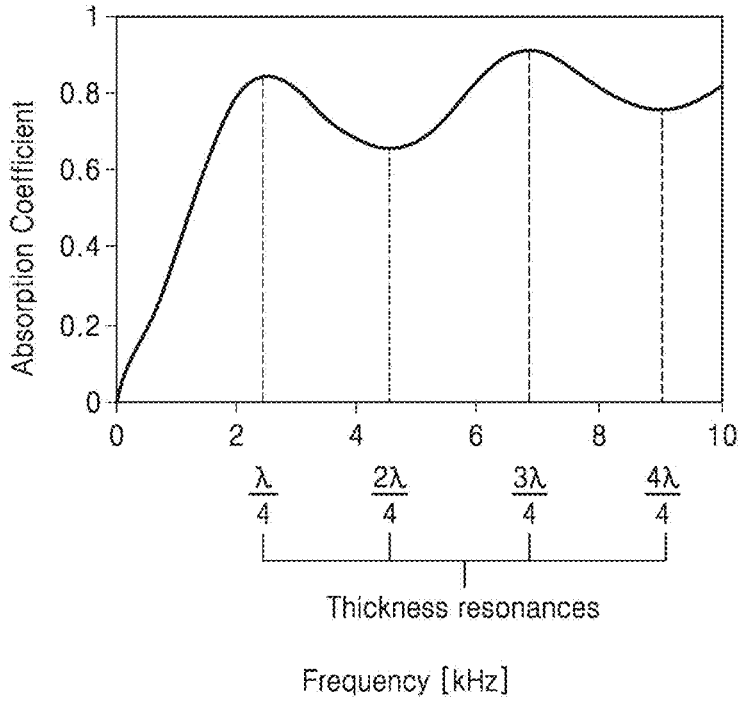
FIG. 1B is an absorption coefficient graph illustrating the performance of the sound absorbing wall illustrated in FIG. 1A.
Figure 2:
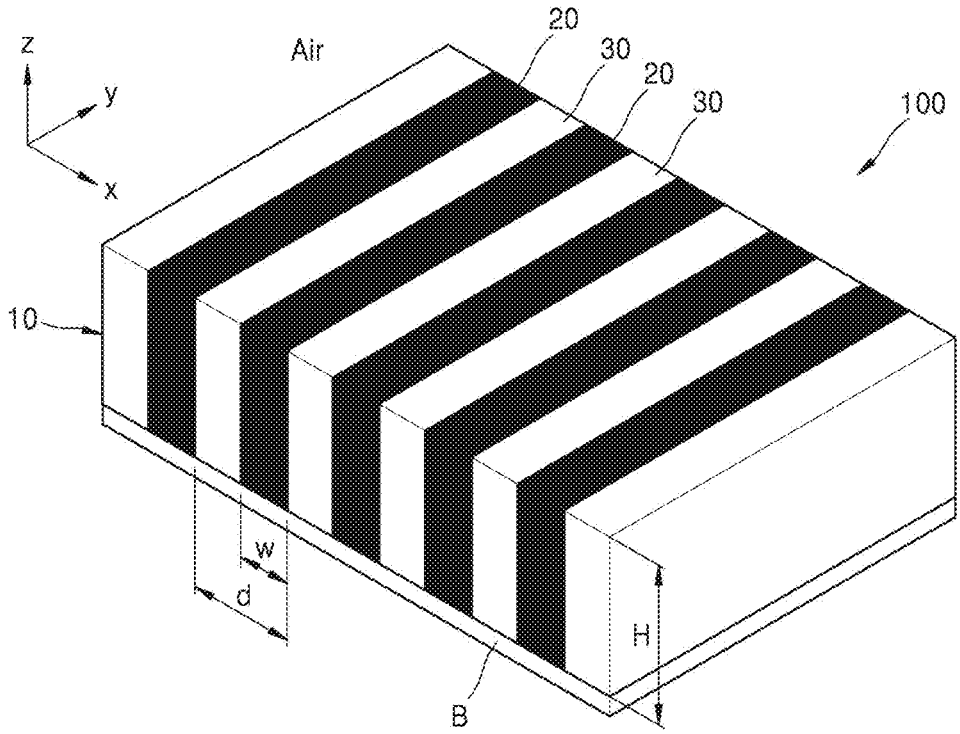
FIG. 2 is a view illustrating an example sound absorbing wall disclosed in Korean Patent No. 10-1626093.

FIG. 1A is a cross-sectional view illustrating a sound absorbing wall including a rigid wall and a porous acoustic absorbent having a thickness and attached to the rigid wall, and FIG. 1B is an absorption coefficient graph illustrating the performance of the sound absorbing wall illustrated in FIG. 1A.

Referring to FIG. 1B, the sound absorption performance of the sound absorbing wall illustrated in FIG. 1A is higher at particular frequencies than at the other frequencies. The reason for this may be a resonance phenomenon occurring when the thickness of the porous acoustic absorbent is similar to the product of an odd number and ¼ of the wavelength of incident waves ($H \cong (2n-1)\lambda/4$, $n=1, 2, 3, \ldots$).

Figure 3:
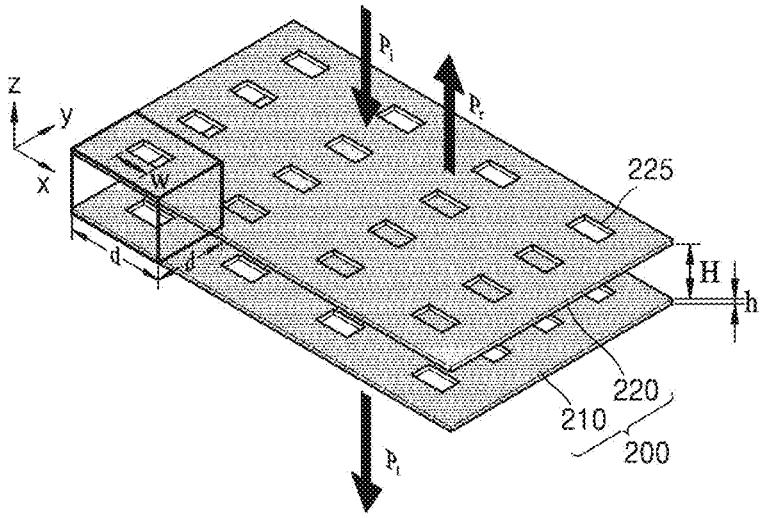
FIG. 3 is a view illustrating a sound insulating panel including two rigid walls that are arranged at a distance from each other and have periodic holes.
Figure 4:
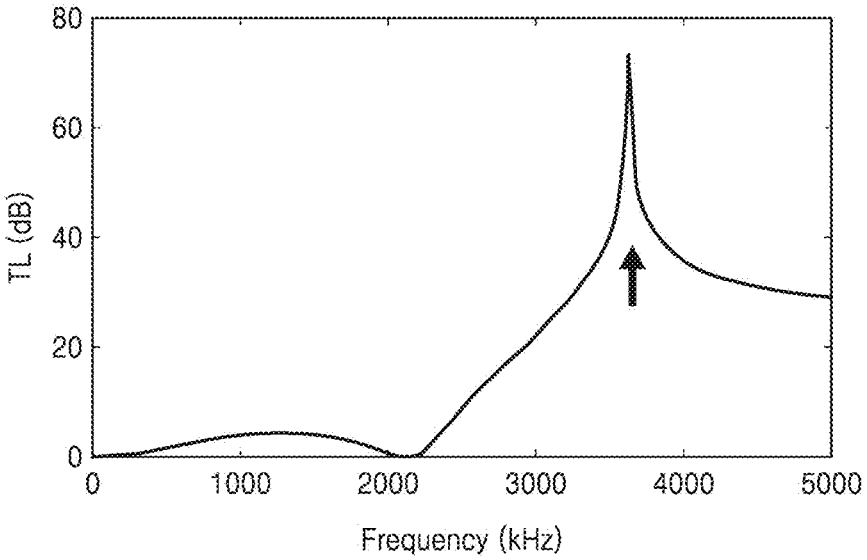
FIG. 4 is a transmission loss graph illustrating the sound insulation performance of the sound insulating panel illustrated in FIG. 3.

FIG. 3 is a view illustrating a sound insulating panel including two rigid walls that are arranged at a distance from each other and have periodic holes. FIG. 4 is a transmission loss graph illustrating the sound insulation performance of the sound insulating panel illustrated in FIG. 3.

Referring to FIG. 4, the transmission loss of the sound insulating panel illustrated in FIG. 3 has a maximum value (peak) at a particular frequency (indicated by an arrow in the graph).

Figure 5:
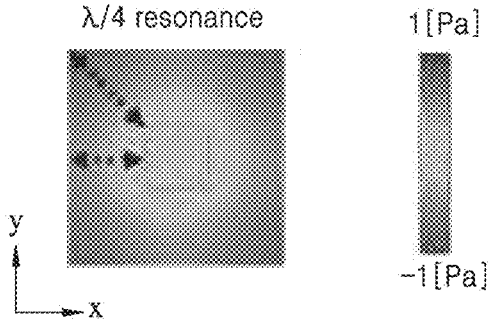
FIG. 5 is a view illustrating a sound pressure distribution at a frequency corresponding to a peak shown in FIG. 3, the sound pressure distribution being obtained in a plane (xy plane) on which a unit structure of the sound insulating panel illustrated in FIG. 3 is placed on the plane (xy plane)
Figure 6:
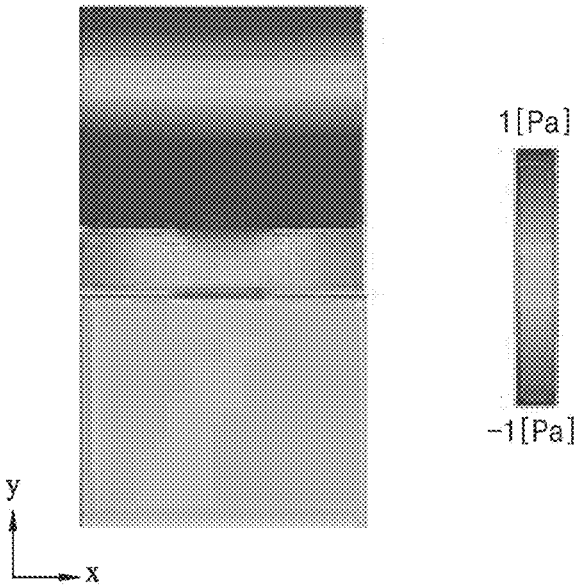
FIG. 6 is a view illustrating a sound pressure distribution in a section of the unit structure taken in an zx plane perpendicular to the plane illustrated in FIG. 5.

FIG. 5 is a view illustrating a sound pressure distribution at the particular frequency corresponding to the peak in a plane (xy plane) on which a unit structure of the sound insulating panel illustrated in FIG. 3 is placed, and FIG. 6 is a view illustrating a sound pressure distribution in a section of the unit structure taken in an zx plane perpendicular to the plane illustrated in FIG. 5.

As illustrated in FIGS. 5 and 6, a resonant mode corresponding to ¼ of the wavelength of sound waves occurs at the frequency corresponding to the peak in a region that is centered on holes formed in two acoustic layers to corners of the unit structure through a space between the two acoustic layers.

Therefore, it was found that the sound absorption performance of an porous acoustic absorbent is significantly affected by a ¼ resonant mode occurring in proportion to the thickness of the porous acoustic absorbent or a characteristic length of a panel on a plane. Thus, if the thickness of an acoustic absorbent is increased, the frequency at which resonance occurs may be lowered.

In the case of a sound insulating panel including two layers, if the size of a unit structure of the sound insulating panel is increased or the size of holes is reduced while maintaining the size of the unit structure, the frequency at which resonance occurs may be further lowered.

In general, however, there is a limit to the thickness of an acoustic absorbent or the size of a unit structure or holes of a sound insulating panel when engineering designs are required, and thus a frequency tailoring method is required for obtaining a high degree of sound absorption and insulation performance without changing original specifications.

Embodiments provide methods of overcoming such limitations by tailoring the velocity of sound. For example, a method of designing a structure for obtaining a low wave propagation velocity is provided. If the velocity of sound waves is reduced, phenomena may occur such as a phenomenon in which waves travel a much longer distance than an originally given distance in a porous acoustic absorbent or an internal space of a double panel, and thus the performance of sound absorption and insulation may be improved at various frequencies by using such phenomena occurring at a low wave propagation velocity and inducing various resonant modes.

In sound absorbing and insulating structures according to embodiments, an acoustic waveguide structure having a plurality of resonators is formed to tailor the velocity of sound. In the following embodiments, rigid partitions are mainly used for simplicity in shape. However, other structures may be used.

Hereinafter, embodiments will be described with reference to the accompanying drawings.

<Embodiment 1>

Figure 7:
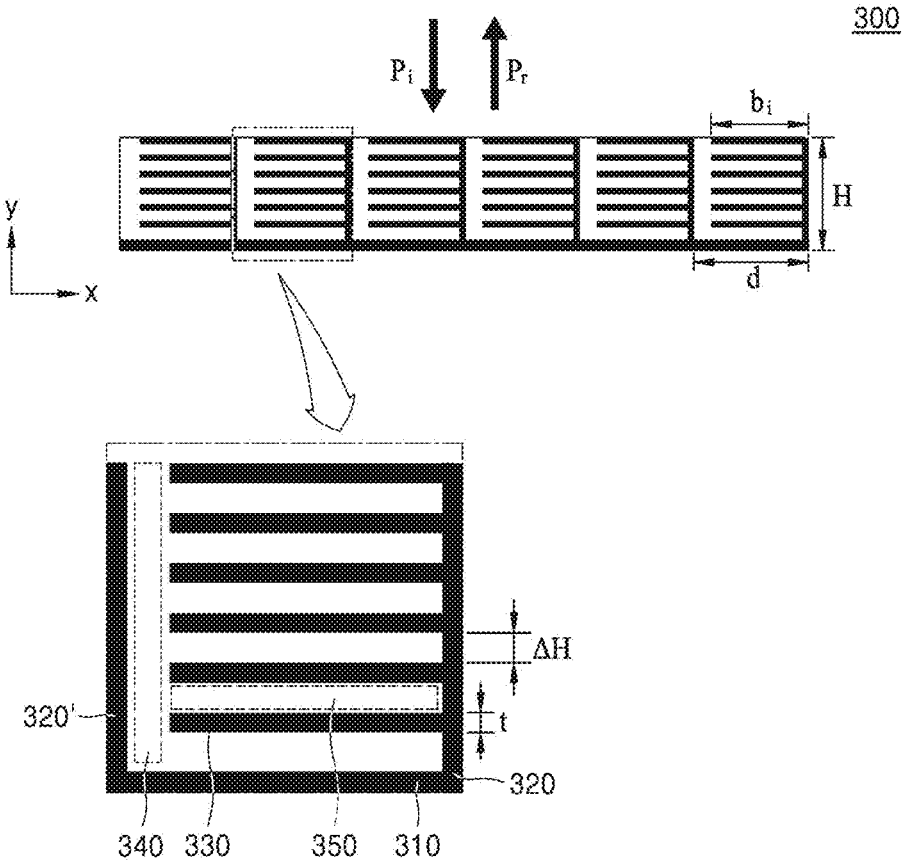
FIG. 7 is a view illustrating a sound absorbing and insulating structure according to Embodiment 1.

FIG. 7 is a view illustrating a sound absorbing and insulating structure 300 according to Embodiment 1.

Referring to FIG. 7, the sound absorbing and insulating structure 300 of Embodiment 1 includes a rigid wall and unit cells continuously arranged in contact with the rigid wall.

The unit cells include a plurality of rigid panels arranged in parallel with the rigid wall, and a fixation frame 320 fixing the rigid panels to the rigid wall.

A space among the rigid wall, the rigid panels, and the frame may be filled with a porous acoustic absorbent.

The sound absorbing and insulating structure 300 having the above-described configuration may be considered as having a porous sound absorbing layer and a sound velocity tailoring structure inserted in the porous sound absorbing layer. That is, unit cells (refer to an enlarged portion in FIG. 7) are repeatedly arranged in particular intervals (d) in the sound velocity tailoring structure inserted in the porous sound absorbing layer. Referring to the enlarged portion of FIG. 7, each unit cell includes: a portion 340 functioning as an acoustic waveguide; and spaces 350 formed between rigid partitions 330 having a length bi, wherein sound waves having particular frequencies resonate in the spaces 350. Since the spaces 350 are located beside the acoustic waveguide, the spaces 350 may be referred to as side resonant spaces 350. The acoustic waveguide 340 and the side resonant spaces 350 may be filled with a porous sound absorbing material. In this case, the velocity of sound waves propagating in the sound absorbing layer decreases until a particular frequency region because sound waves propagating in the acoustic waveguide and the side resonant spaces 350 interact with each other. The acoustic waveguide 340 in one unit cell is formed parallel to the fixation frame 320' of the adjacent unit cell in between the fixation frame 320' of the adjacent unit cell and the ends of the rigid partitions 330.

Figure 8:
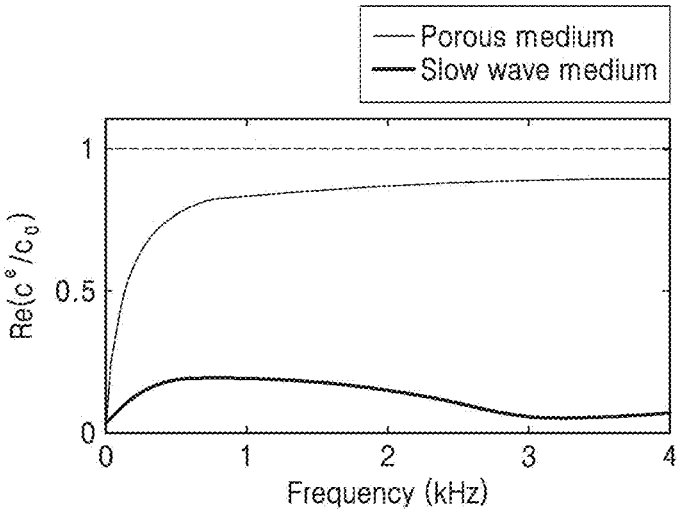
FIG. 8 is a velocity versus frequency graph illustrating the velocity of wave propagation in the general porous acoustic absorbent (denoted by a porous medium) illustrated in FIG. 1A in comparison with the velocity of wave propagation in the sound absorbing and insulating structure (denoted by a slow wave medium) of Embodiment 1 illustrated in FIG. 7.
Figure 9:
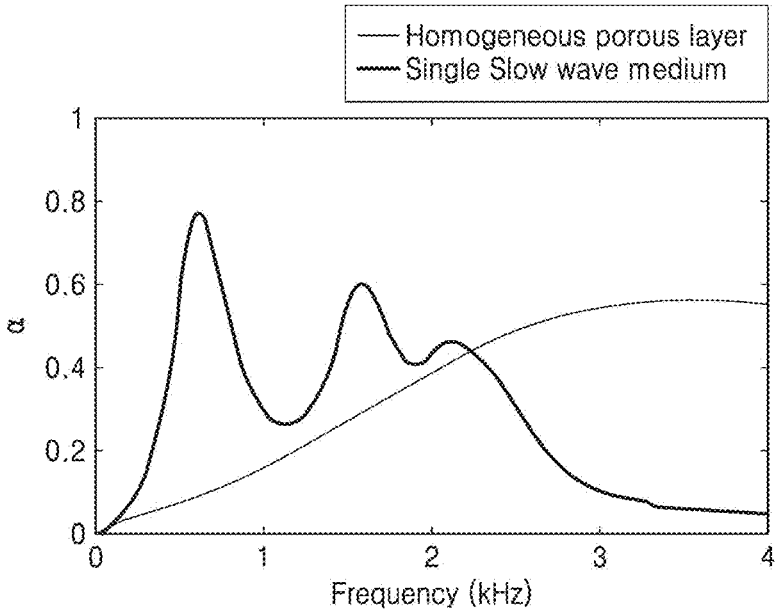
FIG. 9 is a graph illustrating the absorption coefficient of the general porous acoustic absorbent illustrated in FIG. 1A with respect to frequency and the absorption coefficient of the sound absorbing and insulating structure of Embodiment 1 illustrated in FIG. 7 with respect to frequency.

FIG. 8 is a velocity versus frequency graph illustrating the velocity $c_e$ of wave propagation in the general porous acoustic absorbent (denoted by a porous medium) illustrated in FIG. 1A in comparison with the velocity $c_e$ of wave propagation in the sound absorbing and insulating structure 300 (denoted by a slow wave medium) of Embodiment 1 illustrated in FIG. 7, and FIG. 9 is a graph illustrating the absorption coefficient of the general porous acoustic absorbent illustrated in FIG. 1A with respect to frequency and the absorption coefficient of the sound absorbing and insulating structure 300 of Embodiment 1 illustrated in FIG. 7 with respect to frequency.

Referring to FIG. 8, the velocity $c_e$ of wave propagation in the sound absorbing and insulating structure 300 of Embodiment 1 is much lower than the velocity $c_e$ of wave propagation in the general porous acoustic absorbent illustrated in FIG. 1A. In FIG. 8, $c_0$ refers to the velocity of sound in air.

The general porous acoustic absorbent illustrated in FIG. 1A has a peak frequency of about 3500 Hz due to the above-described resonance phenomenon. Unlike this, the performance of the sound absorbing and insulating structure 300 of Embodiment 1 in which waves propagate at a relative low velocity is as shown with a thick line in FIG. 9, and a first resonant peak is present at a frequency of less than about 1000 Hz. In FIG. 9, $\alpha$ refers to an absorption coefficient.

<Embodiment 2>

The sound absorbing and insulating structure 300 of Embodiment 1 is modified to provide a sound absorbing and insulating structure 400 of Embodiment 2 having improved sound absorption performance in a wide frequency range. The sound absorbing and insulating structure 400 of Embodiment 2 will now be described.

Figure 10:
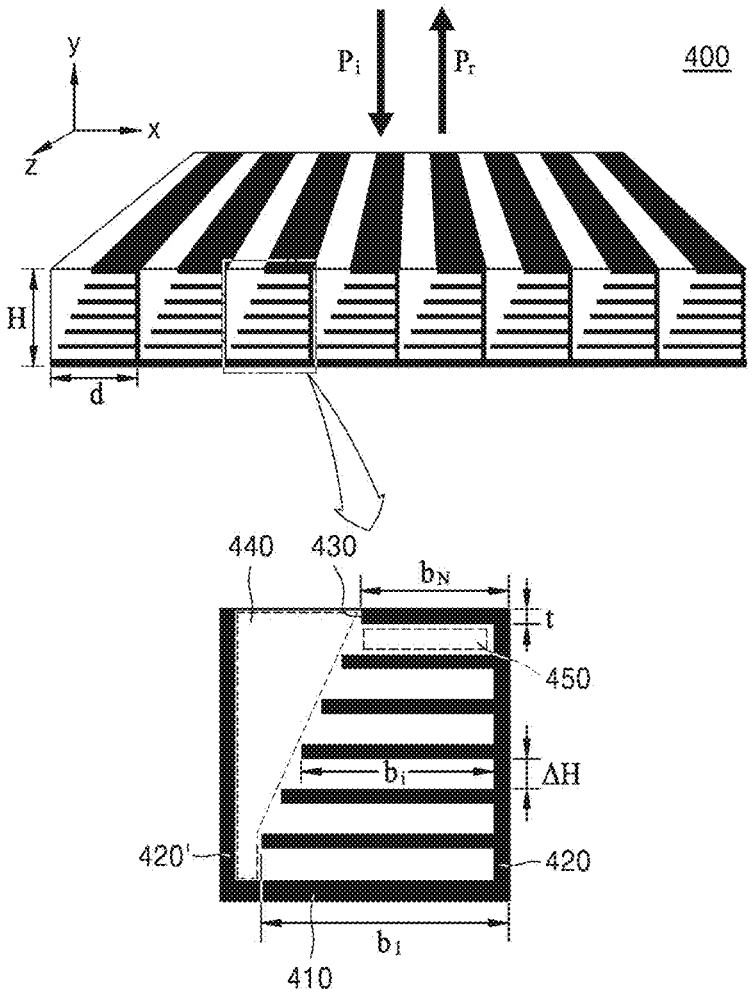
FIG. 10 is a view illustrating a sound absorbing and insulating structure according to Embodiment 2.

FIG. 10 is a view illustrating the sound absorbing and insulating structure 400 according to Embodiment 2.

When the sound absorbing and insulating structure 400 of Embodiment 2 illustrated in FIG. 10 is compared with the sound absorbing and insulating structure 300 of Embodiment 1, rigid partitions 430 have different lengths, and thus side resonant spaces 450 have different sizes. The reason for this is as follows: the velocity of wave propagation relating to the frequency of waves is varied according to resonant frequencies of the side resonant spaces 450, and the resonant frequencies of the side resonant spaces 450 in the above-described design are determined by the lengths of the rigid partitions 430. That is, frequencies at which the velocity of the sound waves is reduced because of resonance, are varied according to the sizes of the side resonant spaces 450, and based on this, the lengths of the rigid partitions 430 are adjusted in such a manner that the sizes of the side resonant spaces 450 increase step by step from the smallest size of the outermost of the side resonant spaces 450. On the contrary, the outermost rigid partition 430 may be longest. In this case, however, the longest rigid partition 430 may hinder sound waves from propagating into the innermost side resonant space 450.

Figure 11:
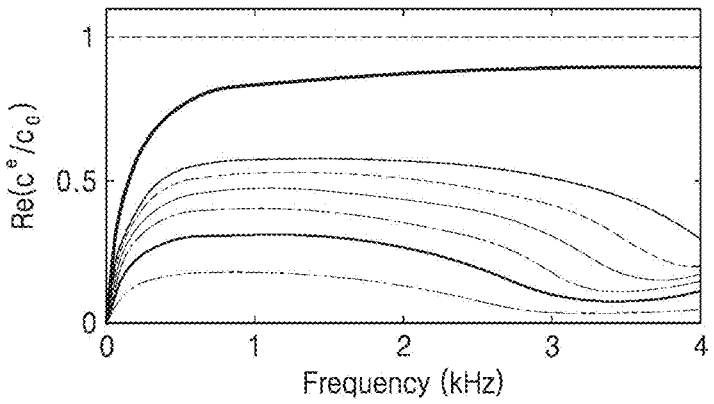
FIG. 11 is a graph including the velocity of sound wave propagation in each layer of the sound absorbing and insulating structure of Embodiment 2 illustrated in FIG. 10 in comparison with the velocity of sound wave propagation in the sound absorbing wall illustrated in FIG. 1A.
Figure 12:
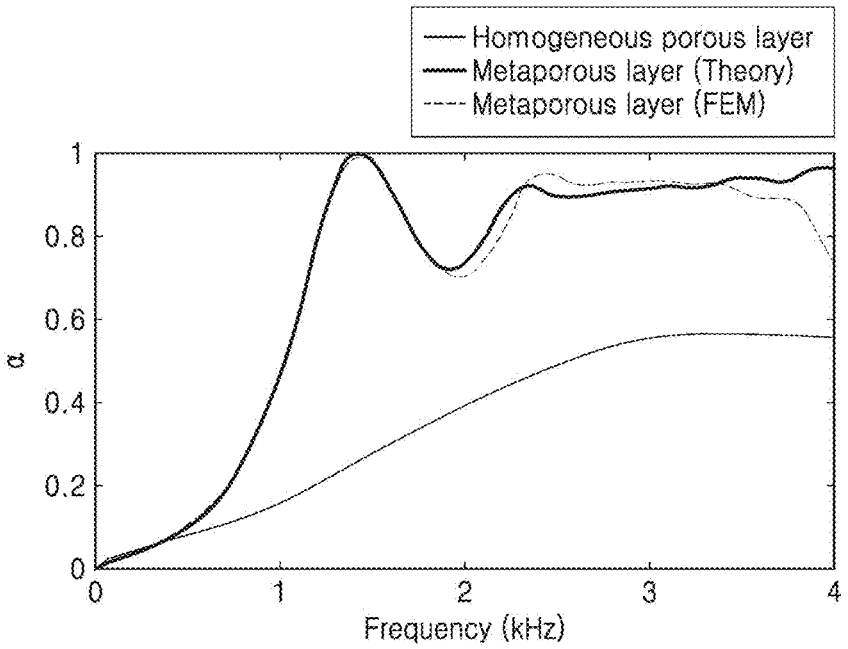
FIG. 12 is a graph illustrating the absorption coefficient of the sound absorbing and insulating structure of Embodiment 2 illustrated in FIG. 10 in comparison with the absorption coefficient of the sound absorbing wall illustrated in FIG. 1A.

FIG. 11 is a graph including the velocity of sound wave propagation in each layer of the sound absorbing and insulating structure 400 of Embodiment 2 illustrated in FIG. 10 in comparison with the velocity of sound wave propagation in the sound absorbing wall including the general porous acoustic absorbent illustrated in FIG. 1A, and FIG. 12 is a graph illustrating the absorption coefficient of the sound absorbing and insulating structure 400 of Embodiment 2 illustrated in FIG. 10 in comparison with the absorption coefficient of the sound absorbing wall illustrated in FIG. 1A.

As illustrated in FIG. 11, the sound absorbing and insulating structure 400 of Embodiment 2 illustrated in FIG. 10 includes a plurality of layers in which waves propagate at different velocities, and the velocities of wave propagation in the layers are various and lower than the velocity of wave propagation in the existing porous medium. In FIG. 11, the uppermost curve indicates the velocity of wave propagation in the existing porous medium. In FIG. 11, the six curves from the bottom indicate the velocities of wave propagation in the layers of the sound absorbing and insulating structure 400 with respect to frequency when waveguides including the side resonant spaces 450 arranged upward from the bottom in the sound absorbing and insulating structure 400 of Embodiment 2 illustrated in FIG. 10 are assumed as effective medium layers.

Owing to the low velocities of wave propagation and the occurrence of various resonant modes, the absorption coefficient $\alpha$ of the sound absorbing and insulating structure 400 is increased in a wide frequency range as illustrated in FIG. 12, and thus the sound absorption performance of the sound absorbing and insulating structure 400 is improved as much as the increase.

A back panel 410 and fixation frames 420,420' not described in the description of Embodiment 2 are substantially the same as those described in Embodiment 1. The position of an acoustic waveguide 440 is substantially the same as the position of the acoustic waveguide in Embodiment 1 but the width of the acoustic waveguide 440 is different from the width of the acoustic waveguide of Embodiment 1 because the rigid partitions 430 have different lengths.

<Embodiment 3>

Figure 13:
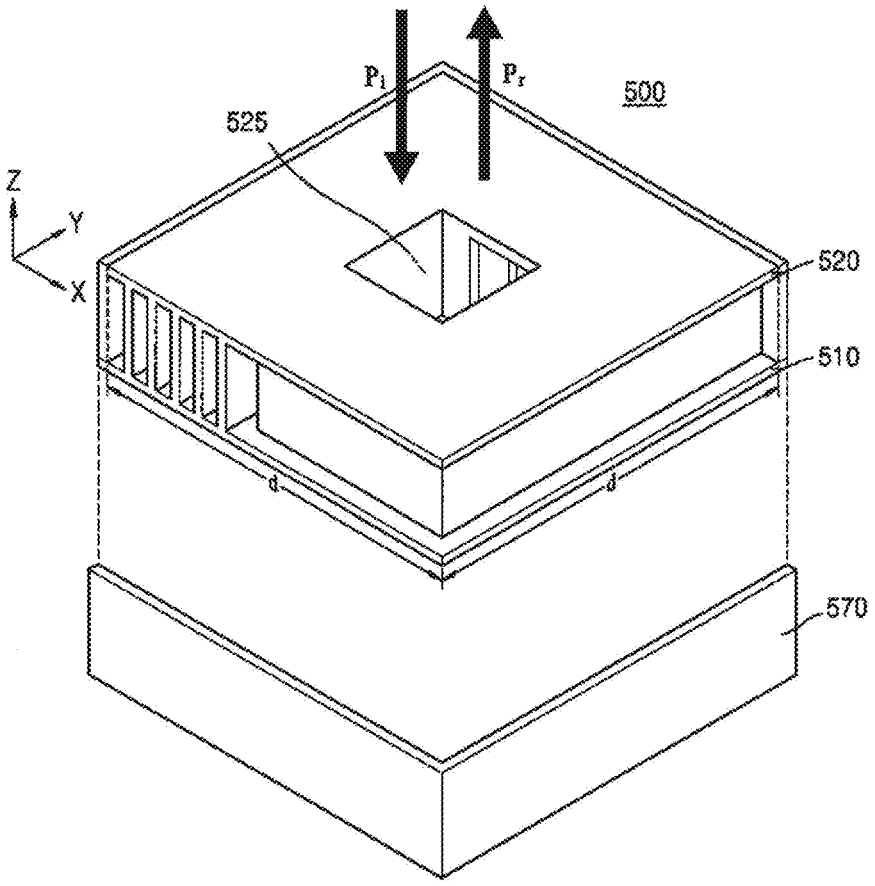
FIG. 13 is a perspective view illustrating a unit structure of a sound absorbing and insulating structure according to Embodiment 3.
Figure 14:
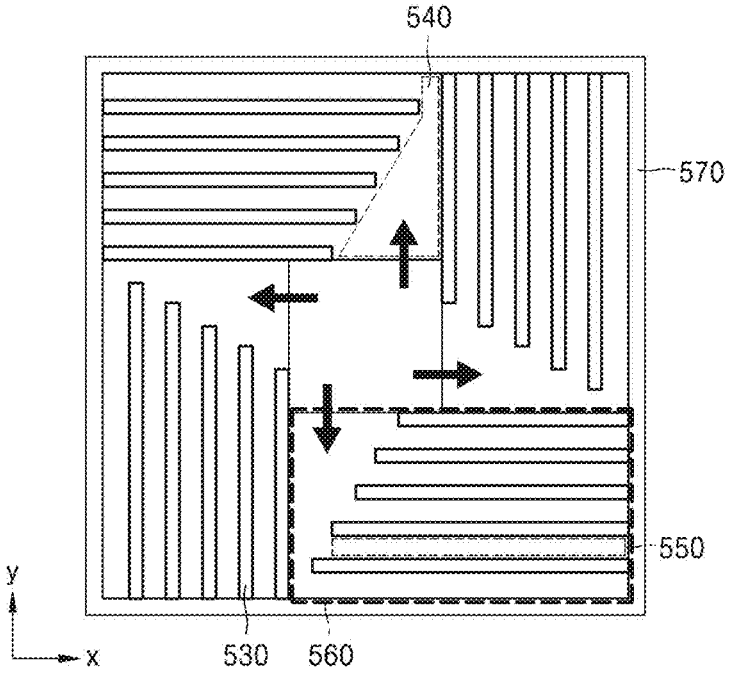
FIG. 14 is a cross-sectional view taken in a plane parallel with an xy plane to illustrate the structure of resonators in the unit structure of the sound absorbing and insulating structure illustrated in FIG. 13.
Figure 15:
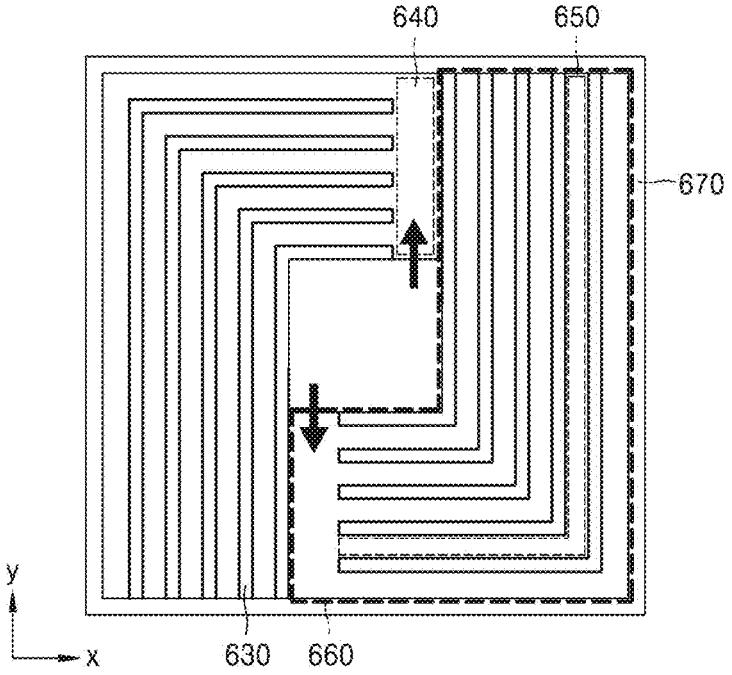
FIG. 15 is a view illustrating a modification of Embodiment 3 in which L-shaped resonators are used.

FIG. 13 is an exploded perspective view illustrating a unit structure of a sound absorbing and insulating structure 500 according to Embodiment 3. FIG. 14 is a cross-sectional view taken in a plane parallel with the xy plane to illustrate the structure of resonators 560 in the unit structure of the sound absorbing and insulating structure 500 illustrated in FIG. 13, and FIG. 15 is a cross-sectional view illustrating a modification of the structure of the resonators 560 illustrated in FIG. 14.

Referring to FIGS. 13 and 14, the sound absorbing and insulating structure 500 of Embodiment 3 includes a front panel 520, a rear panel 510, and the resonators 560.

The front panel 520 and the rear panel 510 are plate-shaped members having areas and spaced apart from each other, and penetration holes are formed in the front panel 520 and the rear panel 510. The penetration holes are formed at substantially the same position in the front panel 520 and the rear panel 510 and have substantially the same size. Each of the front panel 520 and the rear panel 510 includes a rigid body.

The resonators 560 are arranged between the front panel 520 and the rear panel 510, and each of the resonators 560 includes plate-shaped members having ends contacting the front panel 520 and the rear panel 510. Four resonators 560 are provided in one unit structure.

Referring to FIG. 14, a plurality of rigid partitions 530 of each of the resonators 560 have different lengths and are arranged in parallel with each other. Each of the resonators 560 induces resonance in the xy plane, and a region adjacent to the penetration holes and indicated by arrows is an entrance for the resonators 560. The rigid partitions 530 may be arranged in such a manner that the lengths of the rigid partitions 530 decrease in a direction from the outermost sides to inner sides of the unit structure. On the contrary, the outermost rigid partitions 530 may be shortest. In this case, however, the longest rigid partitions 530 may hinder sound waves from propagating into side resonant spaces 550 located on the outermost sides of the unit structure.

The rigid partitions 530 arranged in each of the resonators 560 may form an acoustic waveguide 540 having a plurality of side resonant spaces 550. The side resonant spaces 550 may cause sound waves having a particular frequency to resonate, and thus the velocity of sound may be tailored in the resonators 560. Like the sound absorbing and insulating structure 300 or 400 of Embodiment 1 or 2, various structures may be designed by adjusting the lengths and number of the rigid partitions 530 based on the unit structure, and a space among the front panel 520, the rear panel 510, and the rigid partitions 530 may be filled with a material such as an acoustic absorbent instead of air.

Meanwhile, as shown in FIGS. 13 and 14, the unit structure of the sound absorbing and insulating structure 500 according to the third embodiment of the present invention may further include an outer wall 570 for closing the outline of the unit structure 500. In FIG. 13, a part of the outer wall 570 is shown in a disassembled state to show the structure of the inner rigid partitions 530. By providing the outer wall 570, the side resonant spaces 550 is closed except for the central penetration hole 525, and the sound insulation effect by resonance can be further improved.

<Modification of Embodiment 3>

FIG. 15 illustrates a modification of Embodiment 3 in which L-shaped resonators 660 are used.

As illustrated in FIG. 15, the modification in which two resonators 660 are used may improve the performance of sound insulation. In the modification illustrated in FIG. 15, each rigid partition 630 of each of the resonators 660 has an L-shape. The rigid partitions 630 arranged in each of the resonators 660 may form an acoustic waveguide 640, Even in this modification of embodiment 3, as shown in FIG. 15, an outer wall 670 for closing the outer periphery of the unit structure may be further provided, and the outer wall 670 may be provided so that the side resonant spaces 650 is closed except for the central penetration hole 625, and the sound insulation effect by resonance can be further improved.

Alternatively, two of the four resonators 560 illustrated in FIG. 14 and one of the resonators 660 illustrated in FIG. 15 may be combined.

FIGS. 16 to 19 illustrate results of a test performed in a frequency range of up to about 3000 Hz to evaluate the performance of a sound absorbing and insulating structure 600 provided according to the modification of Embodiment 3.

Figure 16:
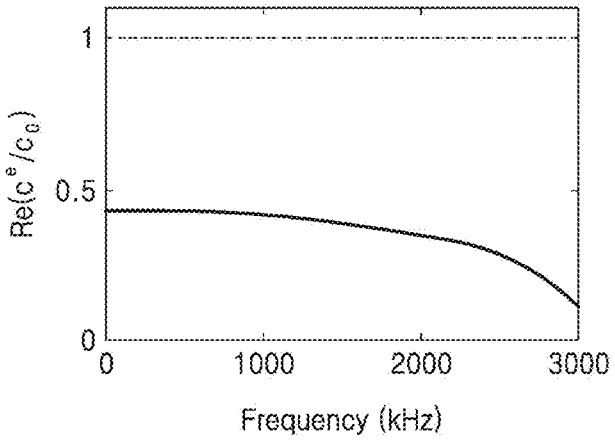
FIG. 16 is a velocity versus frequency graph illustrating the velocity of sound wave propagation in the resonators illustrated in FIG. 14 when rigid partitions of the resonators have the same length.
Figure 17:
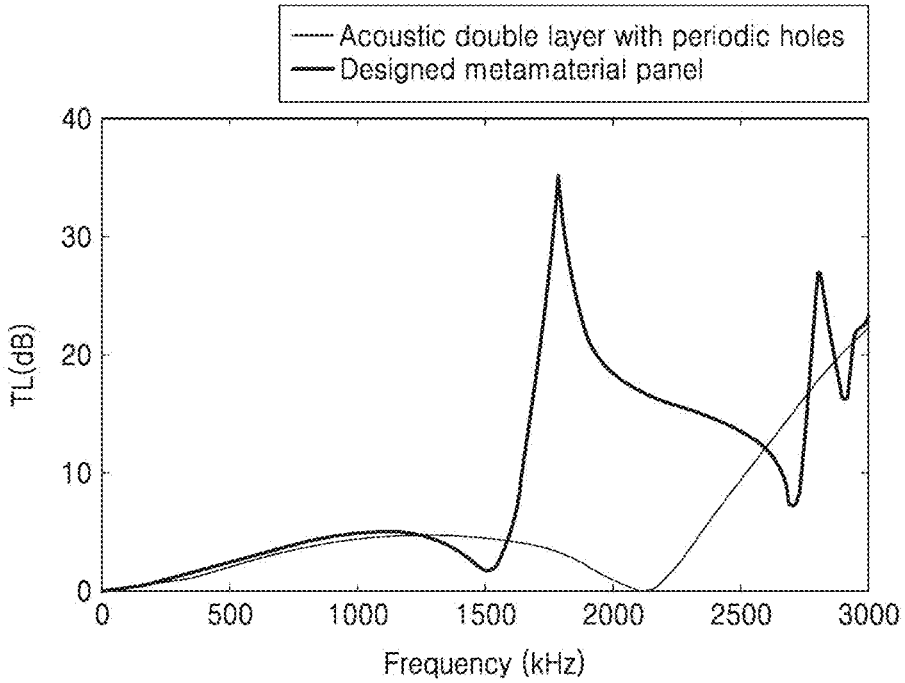
FIG. 17 is a graph illustrating the transmission loss TL of the sound insulating panel including two rigid walls illustrated in FIG. 3 in comparison with the transmission loss TL of the resonators illustrated in FIG. 14 when the rigid partitions of the resonators have the same length.
Figure 18:
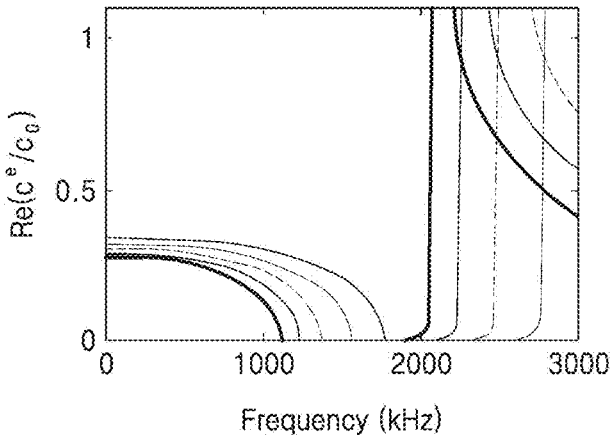
FIG. 18 is a graph illustrating the velocity of sound waves in the sound absorbing and insulating structure of the modification of Embodiment 3 illustrated in FIG. 15.
Figure 19:
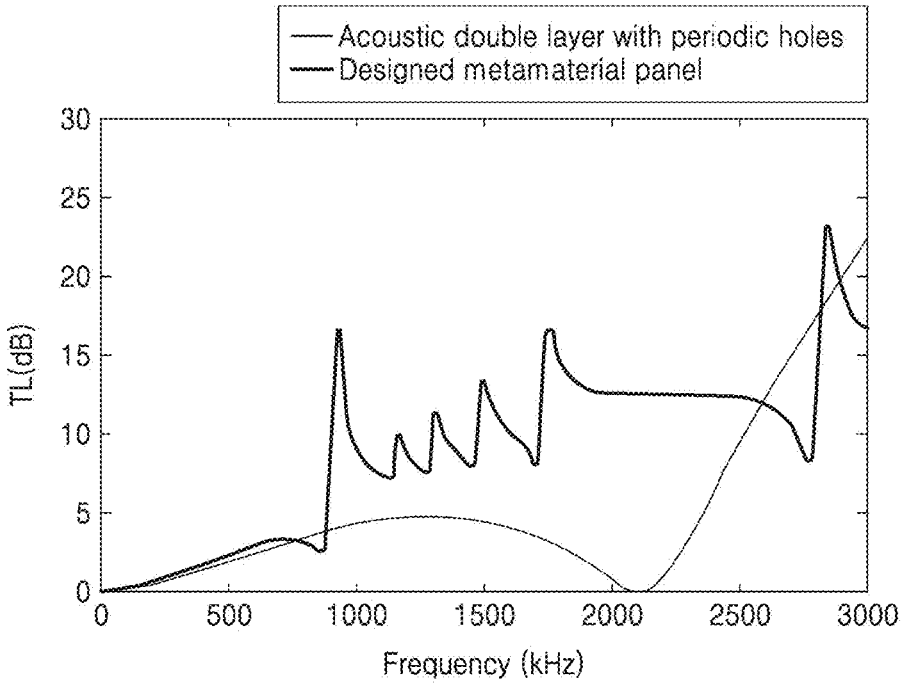
FIG. 19 is a graph illustrating the transmission loss TL of the sound insulating panel including two rigid walls illustrated in FIG. 3 in comparison with the transmission loss TL of the sound absorbing and insulating structure of the modification of Embodiment 3 illustrated in FIG. 15.

FIG. 16 is a velocity versus frequency graph illustrating the velocity of sound wave propagation in the resonators 560 illustrated in FIG. 14 when the rigid partitions 530 have the same length. FIG. 17 is a graph illustrating the transmission loss TL of the sound insulating panel including two rigid walls illustrated in FIG. 3 in comparison with the transmission loss TL of the resonators 560 illustrated in FIG. 14 when the rigid partitions 530 have the same lengths. FIG. 18 is a graph illustrating various sound wave propagation velocities in the sound absorbing and insulating structure 600 of the modification of Embodiment 3 illustrated in FIG. 15. FIG. 19 is a graph illustrating the transmission loss TL of the sound insulating panel including two rigid walls illustrated in FIG. 3 in comparison with the transmission loss of the sound absorbing and insulating structure 600 of the modification of Embodiment 3 illustrated in FIG. 15.

FIGS. 16 and 17 illustrate cases in which the rigid partitions 530 have the same length, and FIGS. 18 and 19 illustrate the case in which the rigid partitions 630 have different lengths according to the modification of Embodiment 3 illustrated in FIG. 15.

The test was performed under the following conditions: a space among the front panel 520, the rear panel 510 or 610, and the rigid partitions 530 or 630 was filled with air; the length of one side of a unit structure was 50 mm; the length of one side of a central penetration hole having a square shape was 15 mm; and the thickness of the rigid partitions 530 or 630 was 2 mm.

Referring to FIG. 16, the sound wave propagates at single valued velocity when the rigid partitions 530 of the resonators 560 have the same length.

Referring to FIG. 17, a transmission loss peak is present in a much lower frequency region in the case in which the rigid partitions 530 have the same length than in the case in which the resonators 560 are not provided.

Referring to FIG. 18, the velocity of sound wave propagation is various according to frequencies in the modification of Embodiment 3 because of various sizes of resonant spaces. The effect of decreasing the velocity of sound wave propagation does not occur in a frequency range of greater than about 2000 Hz. That is, the effect of decreasing the velocity of sound wave propagation occurs in a low frequency range.

As illustrated in FIG. 18, waves propagate at as many velocities as the number of the rigid partitions 630 according to the frequency of the waves when the rigid partitions 630 have different lengths.

In the case of a unit structure not having the resonators 560 or 660, the above-described ¼ wavelength resonant mode does not occur until the frequency of waves reaches about 3000 Hz, that is, occurs when the frequency of waves is higher than about 3000 Hz (refer to narrow lines in FIGS. 17 and 19).

However, in the case of the sound absorbing and insulating structures 500 and 600 of Embodiment 3 and the modification of Embodiment 3, the resonant mode occurs in a relatively low frequency range because the velocity of wave propagation is low in the sound absorbing and insulating structures 500 and 600 as indicated by thick lines in FIGS. 17 and 19, and thus the performance of sound insulation may be improved in a low frequency range. For example, if the structure of the resonators 660 of the modification of Embodiment 3 is used, a plurality of resonant modes may occur in a frequency range of about 2000 Hz or lower, and thus a plurality of peaks may be present.

Therefore, the performance of sound absorption and insulation may be improved according to the embodiments, and a frequency band in which sound absorption and insulation are guaranteed may be effectively adjusted by using the method of tailoring the velocity of sound. For example, it is possible to achieve improvements in the performance of sound absorption and insulation in a frequency band of about 2000 Hz or lower which are difficult to achieve using an existing sound absorbing and insulating structure including a two-layer sound insulating panel and penetration holes formed in the two-layer sound insulating panel.

An embodiment provides a method of designing a sound absorbing and insulating structure based on the above-described embodiments as follows.

The method of designing a sound absorbing and insulating structure according to the embodiment may include measuring the frequency range of noises mainly occurring in a place in which a sound absorbing and insulating structure will be installed, and designing resonators 560 or 660 or the sizes of resonant spaces 350, 450, 550, or 650. Basically, according to the method of designing a sound absorbing and insulating structure of the embodiment, a sound absorbing and insulating structure is arranged in a propagation path of sound waves having an audible frequency range, and the velocity of sound wave propagation is reduced to decrease noises.

According to the embodiment, the method of designing a sound absorbing and insulating structure may include: measuring the frequency range of noises occurring in a place in which the sound absorbing and insulating structure will be arranged; determining the size of a resonator 560 or 660 generating resonance within the measured frequency range; determining the sizes and intervals of a plurality of rigid partitions 330, 430, 530, or 630 to form resonant spaces 350, 450, 550, or 650 corresponding to the determined size of the resonator 560 or 660; and fabricating the sound absorbing and insulating structure by arranging the rigid partitions 330, 430, 530, or 630 having the determined sizes on a rigid panel at the determined intervals.

When the sizes of the resonant spaces 350, 450, 550, or 650 are determined, the thicknesses of the rigid partitions 330, 430, 530, or 630 and the height and width of the sound absorbing and insulating structure may be considered in addition to the lengths and intervals of the rigid partitions 330, 430, 530, or 630. In addition, the width (d) of a unit cell may be considered. If the width (d) increases, sound waves may be reflected or transmitted in various directions, and thus the width (d) may be maintained to be within or smaller than a certain range. For this, the width (d) of the unit cell may be set to be less than a wavelength $\lambda_{min}$ corresponding to a maximum frequency $f_{max}$ in a frequency band ($f_a$, $f_{min} \leq f_a \leq f_{max}$) of sound waves $P_i$ to be absorbed.

In addition, the method of designing a sound absorbing and insulating structure may further include determining whether to design a sound absorbing and insulating structure 300 or 400 including a continuous back panel 310 in which no penetration hole is formed or a sound absorbing and insulating structure 500 or 600 including a resonator 560 or 660 placed between two panel layers in which a plurality of penetration holes are formed.

In addition, the method of designing a sound absorbing and insulating structure may further include: determining whether to fill a space corresponding to an acoustic waveguide 340 or 440 or the resonant spaces 350 or 450 with an acoustic absorbent; and determining the type of the acoustic absorbent. If a porous material is determined as the acoustic absorbent, at least one porous material selected from the group consisting of a polyurethane foam, a polyester foam, a melamine foam, and the like may be used as the acoustic absorbent.

In addition, according to the embodiment, the method of designing a sound absorbing and insulating structure may further include selecting the shape of the resonant spaces 550 or 650 of the resonator 560 or 660 from one of a flat-plate shape and an L-shape. When compared to the case of considering resonant spaces having one shape, the performance of the sound absorbing and insulating structure may be improved in a relatively wide range.

As described above, the method of the embodiment may make it possible to easily design a sound absorbing and insulating structure having improved performance in a place in which the sound absorbing and insulating structure will be placed.

As described above, according to the one or more of the above embodiments, the velocity of sound may be tailored to improve the sound adsorption or insulation performance of the sound absorbing and insulating structures.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A sound absorbing and insulating structure comprising:

a back panel arranged along a sound wave propagation path and having a flat-plate shape;

a first fixation frame and a second fixation frame arranged along a direction crossing the back panel and having a flat-plate shape; and a plurality of rigid partitions spaced apart from the back panel, arranged at intervals in parallel with each other so as to form resonant spaces and fixed to the first fixation frame, wherein an acoustic waveguide is formed parallel to the second fixed frame between the second fixed frame and the ends of the rigid partitions, thereby lowering the speed of the sound waves.

2. The sound absorbing and insulating structure of claim 1, wherein the rigid partitions have different lengths from the fixation frame.

3. The sound absorbing and insulating structure of claim 2, wherein the rigid partitions are sequentially arranged in a long-to-short order.

4. The sound absorbing and insulating structure of claim 1, wherein a space between the back panel and the rigid partitions is filled with an acoustic absorbent.

5. The sound absorbing and insulating structure of claim 2, wherein a space between the back panel and the rigid partitions is filled with an acoustic absorbent.

6. The sound absorbing and insulating structure of claim 3, wherein a space between the back panel and the rigid partitions is filled with an acoustic absorbent.

7. A sound absorbing and insulating structure comprising:

a rear panel comprising a rigid body and a penetration hole;

a front panel arranged at a distance from the rear panel and comprising a rigid body and a penetration hole communicating with the penetration hole of the rear panel; and a plurality of resonators arranged between the rear panel and the front panel around a space connecting the penetration holes of the rear panel and the front panel, wherein the resonators comprise a plurality of rigid partitions arranged in parallel with each other to form resonant spaces, wherein an acoustic waveguide is formed in each resonator, extending in a direction intersecting with an extending direction of the resonant spaces, wherein the acoustic waveguide is formed in between the ends of rigid body partitions belonging to a first resonator of the plurality of resonators and a wall surface of a rigid body partition belonging to a second resonator of the plurality of resonators, to lower a speed of sound waves.

8. The sound absorbing and insulating structure of claim 7, wherein the rigid partitions of the resonators have different lengths.

9. The sound absorbing and insulating structure of claim 8, wherein the rigid partitions of the resonators are sequentially arranged in a long-to-short order.

10. The sound absorbing and insulating structure of claim 7, wherein at least one of the rigid partitions of the resonators has an L-shape.

11. The sound absorbing and insulating structure of claim 7, wherein a space among the rigid partitions of the resonators, the front panel, and the rear panel is filled with an acoustic absorbent.

12. The sound absorbing and insulating structure of claim 8, wherein a space among the rigid partitions of the resonators, the front panel, and the rear panel is filled with an acoustic absorbent.

13. The sound absorbing and insulating structure of claim 9, wherein a space among the rigid partitions of the resonators, the front panel, and the rear panel is filled with an acoustic absorbent.

14. The sound absorbing and insulating structure of claim 10, wherein a space among the rigid partitions of the resonators, the front panel, and the rear panel is filled with an acoustic absorbent.

15. A method of designing a sound absorbing and insulating structure for reducing noises by arranging a sound absorbing and insulating structure in a path along which sound waves having an audible frequency range propagate and reducing a propagation velocity of the sound waves, the method comprising:

measuring a frequency range of sound waves;

determining sizes of resonant spaces or a size of resonators in which resonance occurs in the measured frequency range;

determining sizes and intervals of a plurality of rigid partitions so as to form the resonant spaces corresponding to the determined size of the resonator;

fabricating a sound absorbing and insulating structure by arranging the rigid partitions having the determined sizes on a rigid panel at the determined intervals; and forming an acoustic waveguide in between ends of rigid body partitions belonging to a first resonator and a wall surface of the rigid body partitions belonging to a second resonator, for the acoustic waveguide to connect the resonant spaces of the first resonator and the path along which sound waves propagate, to lower a speed of sound waves.

16. The method of claim 15, further comprising determining whether to design a sound absorbing and insulating structure comprising a continuous back panel in which no penetration hole is formed or a sound absorbing and insulating structure comprising a resonator placed between two layers of a panel in which a plurality of penetration holes are formed.

17. The method of claim 15, further comprising selecting a flat-plate shape or an L-shape as a shape of the resonant spaces of the resonator.

18. The method of claim 16, further comprising selecting a flat-plate shape or an L-shape as a shape of the resonant spaces of the resonator.

* * * * *